US005163673A

United States Patent [19]

Heppenstiel

[11] Patent Number: 5,163,673

[45] Date of Patent: Nov. 17, 1992

[54] SHEET-PROCESSING MACHINE THAT PREVENTS DOUBLE FEED BY DIVERTING THE EXTRANEOUS SHEET

[75] Inventor: Gerhard Heppenstiel, Bamamental, Fed. Rep. of Germany

[73] Assignee: Heidelberger Druckmaschinen AG, Heidelberg, Fed. Rep. of Germany

[21] Appl. No.: 660,646

[22] Filed: Feb. 25, 1991

[30] Foreign Application Priority Data

Feb. 24, 1990 [DE] Fed. Rep. of Germany ..... 4005910

[51] Int. Cl.[5] ..... B65H 29/62; B65H 7/12

[52] U.S. Cl. ..... 271/263; 271/262; 271/284

[58] Field of Search ..... 271/94, 104, 184, 283, 271/284, 198, 225, 260, 262, 263, 265

[56] References Cited

U.S. PATENT DOCUMENTS

| | | | |
|---|---|---|---|
| 2,441,912 | 5/1948 | Streich | 271/284 |
| 3,040,866 | 6/1962 | Rehm . | |
| 3,504,911 | 4/1970 | Silverberg | 271/260 |
| 3,528,739 | 9/1970 | Noda | 271/283 |
| 3,773,321 | 11/1973 | Burroughs | 271/260 |
| 3,778,051 | 12/1973 | Allen et al. | 271/262 |
| 3,955,812 | 5/1976 | Suda et al. | 271/265 |
| 4,030,607 | 6/1977 | Suda et al. | 271/263 |
| 4,635,924 | 1/1987 | Pollich . | |
| 4,637,598 | 1/1987 | Bouwens et al. . | |
| 4,735,407 | 4/1988 | Ozawa | 271/283 |

FOREIGN PATENT DOCUMENTS

| | | | |
|---|---|---|---|
| 1236531 | 9/1962 | Fed. Rep. of Germany | 271/94 |
| 1088070 | 2/1963 | Fed. Rep. of Germany . | |

*Primary Examiner*—Robert P. Olszewski
*Assistant Examiner*—Steven M. Reiss
*Attorney, Agent, or Firm*—Herbert L. Lerner; Laurence A. Greenberg

[57] ABSTRACT

A feed table for a sheet processing machine, includes a double-sheet detector, and a device controllable by the detector for separating out double sheets, respectively, supplied to the feed table together with sheets to be printed, the device including first and second rotatable members for applying suction simultaneously to a sheet to be processed and to a double sheet, respectively, the first and second rotatable members being disposed on opposite sides of a sheet travel plane in which a sheet stream is conveyed, and a sheet guide disposed adjacent the sheet travel plane on the side thereof on which the first rotatable member is located, the first rotatable member being rotatable for guiding the sheet to be processed along the sheet guide and for conveying the sheet to be processed with the sheet stream.

8 Claims, 2 Drawing Sheets

Figure 1A:
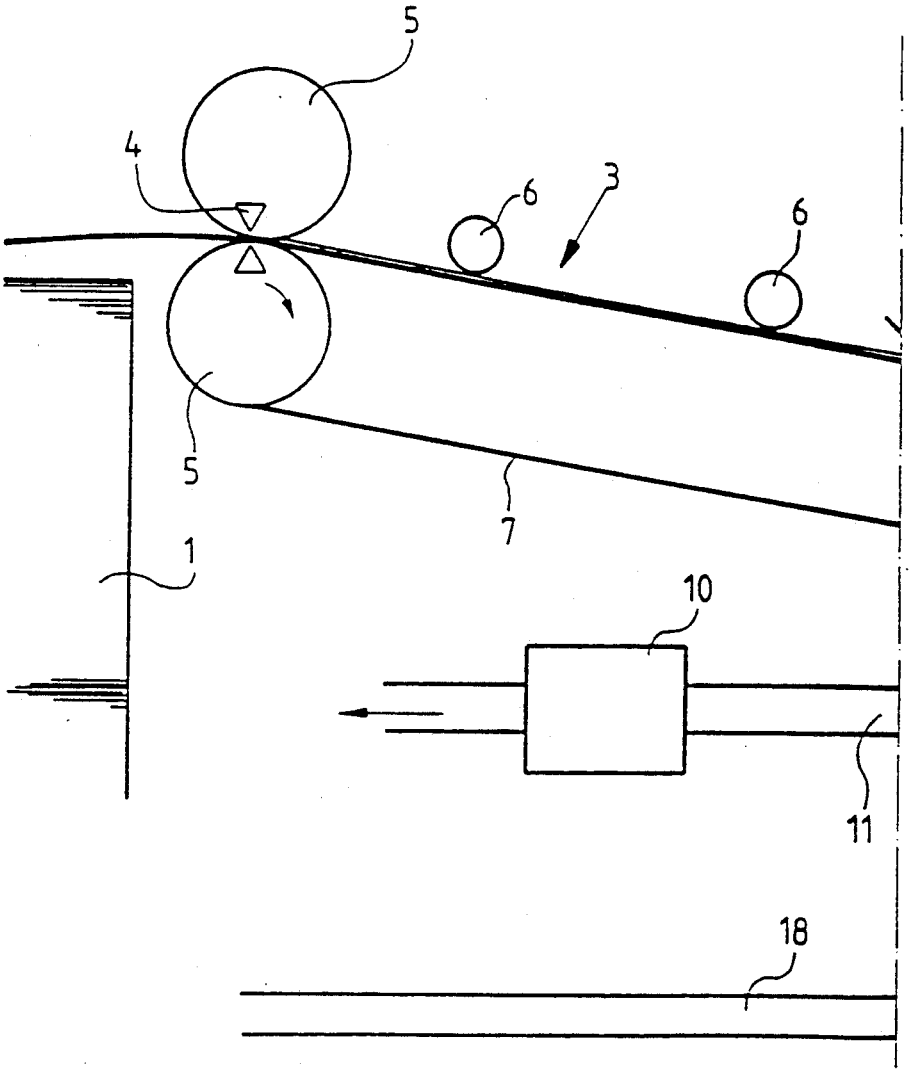

SHEET-PROCESSING MACHINE THAT PREVENTS DOUBLE FEED BY DIVERTING THE EXTRANEOUS SHEET

The invention relates to a sheet-separating device in a sheet-processing machine such as a sheet-fed printing machine, and method of operation thereof.

German Patent (DE-PS) 10 88 070 discloses a device for separating out or sorting double sheets in a sheet-processing machine, especially a printing machine. In this embodiment, a counter roller which is arranged opposite a scanning roller disposed above the sheet-travel plane is constructed for use also as a pneumatic sorting roller which eliminates or removes the supernumerary or double sheet without interrupting the paper feed.

When sheet piles have become relatively high at the sheet feeder, the individual paper sheets often firmly adhere to one another. If a double sheet is conveyed on the feeding table of the printing machine by means of lifting and forwarding suckers, with a printing machine equipped with the aforementioned device for sorting double sheets, there is often a risk that two firmly adhering sheets may not be separated by the air which is discharged from the air nozzles. The air jet which, at high sheet-conveying speeds, impinges only briefly on the leading edge of the double sheet is unable to separate mutually adhering sheets reliably. If the pair of adhering sheets is diverted, the paper feed to the printing machine is interrupted. This results in stand-still or non-operating periods causing undesired costs, which should be avoided as much as possible.

The above-mentioned disadvantages of the state of the art are eliminated by the invention.

It is accordingly an object of the invention to optimize a sheet-separating device so that, even at high machine speeds, firmly-adhering double sheets are separated reliably, and continuous sheet feed to the sheet-processing machine remains assured after the sheet separation.

With the foregoing and other objects in view, there is provided, in accordance with the invention, a feed table for a sheet processing machine, comprising a double-sheet detector, and a device controllable by the detector for separating out double sheets, respectively, supplied to the feed table together with sheets to be printed, the device including first and second rotatable means for applying suction simultaneously to a sheet to be processed and to a double sheet, respectively, the first and second rotatable means being disposed on opposite sides of a sheet travel plane in which a sheet stream is conveyed, and a sheet guide disposed adjacent the sheet travel plane on the side thereof on which the first rotatable means are located, the first rotatable means being rotatable for guiding the sheet to be processed along the sheet guide and for conveying the sheet to be processed with the sheet stream.

In accordance with the invention, there is provided in greater detail, a feed table for a sheet-processing machine, comprising a double-sheet detector, and a device controllable by the detector for separating out double sheets, respectively supplied to the feed table together with sheets to be printed, the device including driven suction rollers, on the one hand, and a pneumatic sorting roller, on the other hand, disposed on opposite sides of a sheet travel plane in which a sheet stream is conveyed for applying suction simultaneously to a sheet to be processed and to a double sheet, respectively, and a sheet guide disposed adjacent the sheet travel plane on the side thereof on which the driven suction rollers are located, the driven suction rollers being rotatable for guiding the sheet to be processed along the sheet guide and for conveying the sheet to be processed with the sheet stream.

In accordance with the invention, there is provided in further detail, a feed table for a sheet-processing machine, comprising a double-sheet detector, and a device controllable by the detector for separating out double sheets supplied to the feed table, the device including a pneumatic sorting roller disposed below a sheet travel plane in which a sheet stream is connected for applying suction to a lower sheet of a pair of mutually adhering sheets, driven suction rollers located above the sheet-travel plane for simultaneously applying suction to an upper sheet of the pair of mutually adhering sheets, and a sheet guide disposed adjacent the sheet travel plane, the driven suction rollers being rotatable for guiding the upper sheet of the pair of mutually adhering sheets along the sheet guide and for conveying the upper sheet with the sheet stream.

These foregoing constructions offer several advantages. Due to the suction rollers being subjected to suction air, suction is applied to the upper sheet or sheet to be printed and to the lower or double sheet, the separation of the double sheet does not have any affect upon the sheet to be printed because the latter sheet is held by the suction rollers and conveyed farther with the sheet flow. The sheet to be printed is advanced past an opening provided in the feed table; thus the continual sheet feed to the processing or printing machine is reliably assured.

In accordance with another feature of the invention, there are provided solenoid valve means connected to the double sheet detector for controlling a suction-air supply to meter suction air to the suction rollers in accordance with the quality of paper forming the respective sheets, and also to the sorting roller, and to shut off the suction-air supply, with a time delay, in accordance with the conveying speed of the sheet stream.

This construction offers the advantage that the required suction air is provided only briefly to the suction rollers. The control via the double sheet detector ensures that the suction-air supply is timely switched on and off. Another advantage is that a relatively small quantity of dirt particles or impurities penetrate into the suction-air system.

In accordance with another aspect of the invention, there is provided a method of operating a device controllable by a double-sheet detector for separating out double sheets supplied to a feed table of a sheet-processing machine, which comprises applying suction simultaneously to a sheet to be processed and to a double sheet from opposite sides of a sheet travel plane in which a sheet stream is conveyed at a given speed and in a given direction, and guiding the sheet to be processed along a sheet guide while maintaining the speed and direction of the sheet to be processed at the given speed and the given direction. The separation and diversion of the double sheet does not affect the travel of the sheets to be processed.

In accordance with an additional feature of the device according to the invention, there are provided conveyor tapes disposed in the sheet travel plane, the suction rollers, respectively, being disposed between the conveyor tapes, the sorting roller having a peripheral surface located below the sheet travel plane at substantially the same height as that of the conveyor tapes, the suction rollers and the sorting rollers having a peripheral speed corresponding to the sheet of the conveyor tapes.

An advantage due to this construction is that a uniform paper-sheet feed to the sheet-processing machine is ensured.

In accordance with an added feature of the invention, the sheet guide is a guide plate having slots formed therein.

In accordance with an alternate feature of the invention, the sheet guide is a fork-shaped member.

The advantages of the latter features are that the sheet to be printed remains in the sheet stream and does not wrap around the suction rollers.

In accordance with a concomitant feature of the invention, the device includes conveyor tapes disposed in the sheet travel plane, the conveyor tapes having an opening therein in a sheet travel direction in the sheet travel plane, and including an auxiliary guide disposed in the opening for guiding the double sheet through the opening and onto a receiver for reuse.

This construction offers the advantage that the double sheets which have been sorted or separated out are centrally accumulated without interrupting the paper sheet feed to the processing or printing machine while eliminating or diverting a double sheet.

Other features which are considered as characteristic for the invention are set forth in the appended claims.

Although the invention is illustrated and described herein as embodied in a sheet-separating device in a sheet-processing machine and method of operation thereof, it is nevertheless not intended to be limited to the details shown, since various modifications and structural changes may be made therein without departing from the spirit of the invention and within the scope and range of equivalents of the claims.

Figure 1B:
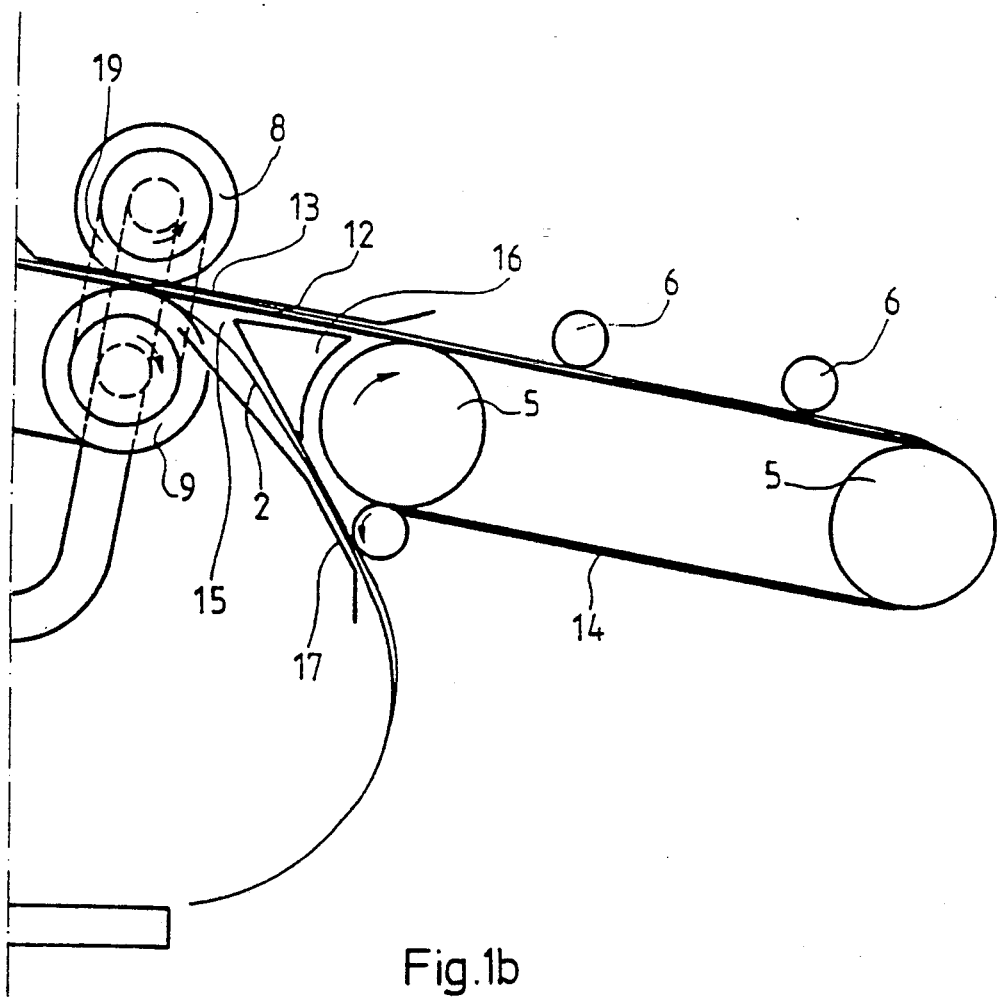

The construction and method of operation of the invention, however, together with additional objects and advantages thereof will be best understood from the following description of specific embodiments when read in connection with the accompanying drawing, in which:

FIGS. 1*a* and 1*b* are diagrammatic side elevational views of a beginning half and an ending half, respectively, of a feed table for a sheet-processing machine constructed in accordance with the invention.

Referring now to the figures of the drawing, there is shown therein a feed table of a sheet-processing machine, namely a printing machine, wherein a double sheet 2 is fed by a non-illustrated feeder from a paper sheet pile 1, together with a sheet 12 to be printed, into a sheet-travel plane 3 of the printing machine, the double sheet 2 being detected by a double-sheet detector 4. It is especially advantageous to employ the feed table according to the invention in a sheet-processing or printing machine having a single-sheet feeder.

The double-sheet detector 4 operates opto-electronically and, in fact, in a conventional manner wherein part of an originally emitted light passing through a single paper sheet is measured, which consequently permits the detection or identification of a double sheet 2. The double sheet 2, together with the sheet 12 to be printed, is then conveyed on conveyor tapes by means of transport rollers 5 and guide rollers in the sheet travel plane 3. The instant the double sheet 2 and the sheet 12 to be printed reach suction rollers 8 arranged above the sheet-travel plane 3, and a pneumatic sorting roller 9 arranged below the sheet-travel plane 3, they are connected, under the control of the double sheet detector 4 via a solenoid valve 10 provided in a suction-air duct 11, to a non-illustrated suction-air source. Instead of the sorting roller 9, other suction rollers like the suction roller 8 or similar means may be used. The suction rollers 8, which are disposed above the sheet-travel plane 3 and through which suction air is applied, grip the single sheet 12 to be printed with suction so that the sheet can be moved farther along a sheet guide or guiding device 13 which prevents it from being wrapped around the suction rollers 8. The sheet guide 13 is formed as a plate having slots therein through which the suction rollers 8 slightly extend, or it may be formed as a fork-like member. After the sheet guide 13, the single sheet 12 to be printed is directed to sheet-aligning means, via a supporting wedge 16, guide rollers 6 and conveyor or transport tapes 14, at an unchanged sheet-conveying speed and an unchanged direction of travel.

In contrast therewith, the double sheet 2 is gripped by the pneumatic sorting roller 9 and diverted through an opening 15 formed in the sheet-travel plane 3 and extending transversely to the sheet-conveying direction between the conveyor tapes 7 and 14. The double sheet 2 is guided by the wedge 16 and an auxiliary guide 17 to a delivery tray 18 for reuse.

As also represented in the figures of the drawing, the upper suction rollers 8 are connected to the pneumatic sorting roller 9 via a common suction-air line 19 which, in turn, is connected to the suction-air duct 11. It is also conceivable that separate suction-air lines may be used for separately conducting the suction air away from the suction rollers 8 and from the pneumatic sorting roller 9. When separate suction-air lines are used, suction air has to be applied to the lines simultaneously, in a conventional manner controlled by a control device. This ensures that, upon the arrival of a double sheet 2, the single sheet 12 to be printed, which accompanies it, is gripped by the suction from upper suction rollers 8 and simultaneously, the double sheet 2 is gripped by suction from the pneumatic sorting roller 9, thus ensuring a reliable and safe double-sheet separation.

The double-sheet detector 4 switches-on the suction-air supply to the suction rollers 8 and to the sorting roller 9, as a function of the sheet-conveying speed, sufficiently early that, upon the arrival of the double sheet 2 at the suction roller 8 and the sorting roller 9, suction air is supplied to the suction rollers 8 and to the sorting roller 9. The suction air, the quantity of which is metered based upon the quality of the paper, is switched off again, with a time delay, so that the suction air supply remains switched-on only rather briefly.

I claim:

1. Feed table for a sheet processing machine, comprising a double-sheet detector, and a device controllable by said detector for separating out double sheets, respectively, supplied to the feed table together with sheets to be printed, said device including first and second rotatable means for applying suction immediately to a sheet to be processed and to a double sheet, respectively, said first and second rotatable means being rotatable in opposite directions and being mounted at stationary locations on opposite sides of a sheet travel plane in which a sheet stream is conveyed, and a sheet guide disposed adjacent the sheet travel plane on the side thereof on which said first rotatable means are located, said first rotatable means being rotatable for guiding the sheet to be processed along said sheet guide and for conveying the sheet to be processed with the sheet stream.

2. Feed table for a sheet-processing machine, comprising a double-sheet detector, and a device controllable by said detector for separating out double sheets, respectively supplied to the feed table together with sheets to be printed, said device including driven suction rollers, on the one hand, and a pneumatic sorting roller, on the other hand, mounted at stationary locations on opposite sides of a sheet travel plane in which a sheet stream is conveyed for applying suction simultaneously to a sheet to be processed and to a double sheet, respectively, and a sheet guide disposed adjacent the sheet travel plane on the side thereof on which the driven suction rollers are located said drive suction rollers being rotatable for guiding the sheet to be processed along said sheet guide and for conveying the sheet to be processed with the sheet stream.

3. Feed table for a sheet-processing machine, comprising a double-sheet detector, and a device controllable by said detector for separating out double sheets, respectively supplied to the feed table together with sheets to be printed, said device including driven suction rollers, on the one hand, and a pneumatic sorting roller, on the other hand, disposed at fixed locations on opposite sides of a sheet travel plane in which a sheet stream is conveyed for applying suction simultaneously to a sheet to be processed and to a double sheet, respectively, a sheet guide disposed adjacent the sheet travel plane on the side thereof on which the driven suction rollers are located, said driven suction rollers being rotatable for guiding the sheet to be processed along said sheet guide and for conveying the sheet to be processed with the sheet stream, and solenoid valve means connected to said double sheet detector for controlling a suction-air supply to meter suction air to said suction rollers in accordance with the quality of paper forming the respective sheets, and also to said sorting roller, and to shut off said suction-air supply, with a time delay, in accordance with the conveying speed of the sheet stream.

4. Feed table for a sheet-processing machine, comprising a double-sheet detector, and a device controllable by said detector for separating out double sheets, respectively supplied to the feed table together with sheets to be printed, said device including driven suction rollers, on the one hand, and a pneumatic sorting roller, on the other hand, disposed at fixed locations on opposite sides of a sheet travel plane in which a sheet stream is conveyed for applying suction simultaneously to a sheet to be processed and to a double sheet, respectively, a sheet guide disposed adjacent the sheet travel plane on the side thereof on which the driven suction rollers are located, said driven suction rollers being rotatable for guiding the sheet to be processed along said sheet guide and for conveying the sheet to be processed with the sheet stream, and conveyor tapes disposed in said sheet travel plane, said suction rollers, respectively, being disposed between said conveyor tapes, said sorting roller having a peripheral surface located below said sheet travel plane at substantially the same height as that of the conveyor tapes, said suction rollers and said sorting rollers having a peripheral speed corresponding to the sheet of the conveyor tapes.

5. Device according to claim 1, wherein said sheet guide is a guide plate having slots formed therein.

6. Device according to claim 1, wherein said sheet guide is a fork-shaped member.

7. Device according to claim 1, including conveyor tapes disposed in said sheet travel plane, said conveyor tapes having an opening therein in a sheet travel direction in said sheet travel plane, and including an auxiliary guide disposed in said opening for guiding the double sheet through said opening and onto a receiver for reuse.

8. Feed table for a sheet-processing machine, comprising a double-sheet detector, and a device controllable by said detector for separating out double sheets supplied to the feed table, said device including a pneumatic sorting roller mounted at a stationary location below a sheet travel plane in which a sheet stream is connected for applying suction to a lower sheet of a pair of mutually adhering sheets, driven suction rollers mounted at a stationary location above said sheet-travel plane for simultaneously applying suction to an upper sheet of the pair of mutually adhering sheets, and a sheet guide disposed adjacent the sheet travel plane, said driven suction rollers being rotatable for guiding the upper sheet of the pair of mutually adhering sheets along said sheet guide and for conveying the upper sheet with the sheet stream.

* * * * *